United States Patent [19]

Miller et al.

[11] 4,163,376

[45] Aug. 7, 1979

[54] TUMBLER WHEEL COMBINATION LOCKS WITH TORQUE ADJUSTER MEANS

[75] Inventors: Benson L. Miller; Steven Helesfai, both of Nicholasville, Ky.

[73] Assignee: Sargent & Greenleaf, Inc., Nicholasville, Ky.

[21] Appl. No.: 886,922

[22] Filed: Mar. 15, 1978

[51] Int. Cl.[2] ..... E05B 37/08

[52] U.S. Cl. ..... 70/303 A; 70/323

[58] Field of Search ..... 70/303 A, 303 R, 301, 70/302, 323, 326, 327, 328

[56] References Cited

U.S. PATENT DOCUMENTS

| | | | |
|---|---|---|---|
| 2,779,185 | 1/1957 | Papini | 70/326 |
| 3,436,941 | 4/1969 | Potzick | 70/327 |

*Primary Examiner*—Robert L. Wolfe

*Attorney, Agent, or Firm*—Mason, Fenwick & Lawrence

[57] ABSTRACT

A combination lock of the tumbler wheel type having a plurality of tumbler wheels journaled for rotation on a stationary tumbler post within a lock case and means such as a driving cam for rotating the tumbler wheels to angular positions for unlocking the lock, wherein the lock case is provided with inclined ramp surfaces adjacent one end of the stack of tumbler wheels and a torque adjustment member having spring finger formations movable on the inclined ramp surface is adjustable responsive to insertion and operation of a tool into the lock mechanism chamber of the case to apply selected spring compression forces to the tumbler wheel stack and adjust the tension or torque properties thereof.

24 Claims, 12 Drawing Figures

TUMBLER WHEEL COMBINATION LOCKS WITH TORQUE ADJUSTER MEANS

BACKGROUND AND OBJECTS OF THE INVENTION

The present invention relates in general to combination locks, and more particularly to combination locks of the tumbler wheel type having a wheel tension adjuster mechanism permitting the tension on the stack of tumbler wheels to be set properly to achieve a predetermined torque in operation of the lock.

Conventional locks of the class known as combination locks usually comprise three or four tumbler wheels which are loosely journaled in a coaxial, side-by-side spaced stack for rotation within a lock casing on a tubular arbor or tumbler post projecting inwardly from the front wall of the casing or from the rear cover plate. The lock dial, which usually has 100 peripheral calibration marks thereon, is affixed to a dial spindle which extends through the bore of the tumbler post and has keyed to the inner end thereof a disc-like drive cam which is likewise arranged coaxially with and spaced rearwardly from the stack of tumbler wheels. A drive pin projects forwardly from the drive cam and with a conventional fly rotatable through a limited arc and associated with the rearmost tumbler wheel, provides a lost motion coupling to drive the tumbler wheel in selected relation to the drive cam. A similar lost motion coupling is provided between each of the successive tumbler wheels so that each of the tumbler wheels may be driven upon predetermined rotation of the drive cam. A thin spacer washer is also customarily provided between each of the tumbler wheels. Each of the flies or fly members between the successive tumbler wheels and between the rearmost tumbler wheel and the drive cam typically comprise a ring portion journaled in concentric relation with the associated tumbler wheel and a radial projection which lies between a pair of stop shoulders disposed to abut portions of the radial projection and limit angular rotation of the fly to about 20° or other desired limited angular range. A drive pin or lug projects from the adjacent tumbler wheel into position to abut the radial projection of the fly and transmit rotation to the adjacent tumbler wheel after the fly has moved through its predetermined lost motion angular range. Each of the tumbler wheels and the drive cam is provided with a peripheral notch or gate at a selected radial position on the drive cam and tumblers.

A fence lever which is pivotally connected near one end on a reciprocative bolt member slidably supported in the lock casing is provided with a depending nose near the opposite or free end of the fence lever which is designed to ride upon the drive cam periphery, in conventional combination locks, and has a bar or fence projecting laterally from the fence lever in overlying relation to the peripheries of the tumbler wheels. The position of the fence in relation to the length of the fence lever nose is usually such that the fence is spaced slightly outwardly from the peripheries of the tumbler wheels when the fence lever nose is riding on the drive cam periphery.

The combination lock is opened, in the case of such conventional combination lock structures, by rotation of the dial in a predetermined sequence in clockwise and counterclockwise directions through predetermined numbers of revolutions to a series of numerical positions indicated by alignment of numbers or indicia on the lock dial with a fixed index adjacent the lock dial periphery, to dial a predetermined series of combination numbers and thereby effect angular rotation of the plurality of tumbler wheels to positions which result in alignment of the tumbler wheel peripheral gates with the fence, and the dial is then rotated to bring the drive cam gate to a position registered with the fence lever nose to cause the fence lever nose and fence to drop into the gates whereupon further rotation of the dial through a partial revolution in a predetermined direction achieves retraction of the bolt.

Also, combination locks have been provided with various types of guard or shielding mechanisms mounted on the drive cam to resist detection of the "feel" of the points of engagement of the fence lever nose with the driving cam gate in accordance with well-known lock manipulation procedures to resist opening of the lock by unathorized persons who do not have authorized knowledge of the combination to which the lock has been set. Examples of such locks designed to defeat unathorized detection of the lock combination are found in prior U.S. Pat. Nos. 2,575,674 and 2,807,954 as typical examples.

For various reasons, it has been found desirable to provide such combination locks, either of the conventional type or of the detection resistant type, with means for applying variable tension forces to the stack of tumbler wheels to effect adjustment at the factory or in the field, of the torque characteristics of the tumbler wheels and operating mechanism therefor, so that the lock can be set to different torque values or specification requirements and will maintain a constant torque at the desired setting throughout the useful life of the lock, or be capable of readjustment to maintain the predetermined desired torque characteristics. For example, the United States Government typically specifies that a fifteen ounce torque level be provided on the tumbler wheels of combination locks when delivered, providing a margin of safety above the torque level actually needed to protect the lock against vibration of the tumbler wheels to positions making compromise of the lock by unauthorized persons easier. While prior combination locks of the tumbler wheel type have been provided, in some patent disclosures, with a bowed or curved spring washer or disc, either between successive tumbler wheels or between the forwardmost tumbler wheel and the stack of tumbler wheels and the front wall of the lock casing, we are aware of no prior tumbler wheel combination locks having a means for setting the torque characteristics of the tumbler wheel stack and the rotatable operating components of the lock to different tensions or torque settings and wherein the tension forces on the stack of tumbler wheels and the torque properties thereof can be changed to different tensions or torques by an adjuster wrench or tool during manufacturer assembly of the lock or in the field.

An object of the present invention, therefore, is the provision of a novel combination lock construction of the tumbler wheel type, wherein means are provided for setting and varying the wheel tension force or torque characteristics of the lock.

Another object of the present invention is the provision of a novel combination lock having a stack of tumbler wheels and a rotatable dial and drive cam assembly for adjusting the same, wherein a torque adjustment mechanism is incorporated in the lock adjustable by a tool or wrench introduced into the lock mechanism chamber for setting the wheel tension or torque characteristics to a desired value and for adjusting or changing the tension or torque characteristics of the stack of tumbler wheels.

A further object of the present invention is the provision of a combination lock having a plurality of tumbler wheels arranged in a stack associated with a driving cam and a rotatable dial for operating the same, having a ramp mechanism and angularly adjustable tension applying spring member movable on the ramp mechanism to different angular positions applying different spring tension forces to the stack of tumblers for adjusting the torque thereof, together with means responsive to insertion and operation of a tool into the lock mechanism chamber to effect angular adjustment of the tension force applying spring means.

Other objects, advantages and capabilities of the present invention will become apparent from the following detailed description, taken in conjunction with the accompanying drawings illustrating preferred embodiments of the invention.

DETAILED DESCRIPTION OF A PREFERRED EMBODIMENT

Figure 1:
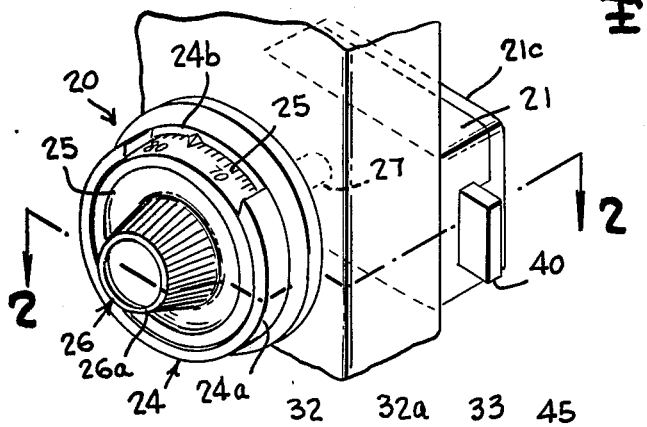
FIG. 1 is a perspective of a combination lock constructed in accordance with the present invention.

Referring to the drawings, wherein like reference characters designate corresponding parts throughout the several figures, there is illustrated a combination lock generally indicated by the reference character 20, which is of the general type disclosed in the prior U.S. Pat. Nos. 2,275,674 and 2,807,954 issued to Harry C. Miller, or 3,968,667 issued to Klaus W. Gartner, all assigned to Sargent & Greenleaf, Inc., but which may optionally employ a normal drive cam as illustrated herein without special compromise-resisting features, rather than providing drive cams having guard mechanisms as disclosed in those earlier patents. While the specific embodiments of the invention hereinafter described involve application of the torque adjuster structure to combination locks of the type shown in FIGS. 2 and 3 having three tumbler wheels and a pivoted fence lever of the configuration shown, it is to be understood that the torque adjuster invention is applicable to all types of combination locks. The combination lock comprises a substantially rectangular lock case 21 having top and bottom walls **21*a*, 21*b* and a hollow boss or tumbler post 22 projecting rearwardly from the front wall 23 thereof. A removable rear cover plate 21*c* is provided to close the rear of the lock case 21. The lock case 21 is designed to be mounted against the inner surface of a door or other closure in the conventional manner, as by mounting screws extending through screw holes near the corners of the lock case and into the supporting door. Secured to the outer face of the supporting door concentric with the axis of the tumbler posts 22 is a dial ring 24, here shown as having a cylindrical shield 24*a* surrounding and shielding from view the major portion of the peripheral flange 25*a* of the dial portion 25 of the dial and knob members 26, the shield 24*a* being interrupted by a sight opening 24*b*** of suitable circumferential extent.

The dial and knob member 26 is supported for rotation within the forwardly opening cylindrical well of the dial ring 24 defined by the shield **24*a*, and includes a drive spindle 27 coupled at its outermost end to the dial and knob member 26 and extending through the hollow tubular post 22 on the front wall of the lock case 21 to be rotatably journaled by the tumbler post and supported at the desired position. The dial and knob member 26 has an integral knob portion 26*a* thereon which projects forwardly from the dial portion 25 and preferably has a knurled periphery to facilitate manipulation of the dial and knob member 26**.

The spindle 27 in the preferred embodiment may be assembled to the dial and knob member 26 by a coupling mechanism similar to that disclosed in prior U.S. Pat. No. 2,951,358 granted to Harry C. Miller, wherein the forward end portion of the spindle 27 is provided with a knurled cylindrical region which is driven into a central bore extending axially through a coupling bushing forming a serrated head adapted to interfit in a rearwardly facing serrated cylindrical well in the dial and knob member 26, the coupling bushing being provided with a constricted neck portion of sufficient length to accommodate the knurled end portion of the spindle 27 and having an enlarged diameter annular body portion providing an uninterrupted series of teeth to be interfitted with similar teeth along the cylindrical surface of the well so that the spindle may be assembled with the dial and knob member at various angular positions. Alternatively, the spindle may simply be a rod having a threaded exterior and a kerf extending along most of its length from the rearmost end thereof, with the forwardmost end fixed in the dial and knob member 26 in any desired manner.

The threaded rearmost end of the drive spindle 27 receives an internally threaded portion of a tubular boss formation **32*a* projecting forwardly integrally from the driving cam 32. The driving cam 32 is keyed to the drive spindle 27 at the desired angular position by inserting a suitable spline key 33 into a radial groove in the center bore of the drive cam which is aligned radially with the longitudinal spline and with the kerf in the spindle 27** to interlock these components against further relative rotation.

A stack or array of a plurality of tumbler wheels, for example a three wheel stack indicated by the reference characters 35, 36 and 37, are supported to rotate freely upon the portion of the hollow boss or tumbler post 22 provjecting rearwardly from the front wall of the lock case 21. It will be appreciated, of course, that a four tumbler wheel stack, or a stack of any other number of tumbler wheels may be used, and that the tumbler post may be carried by the rear wall or cover plate instead of the front wall, as is well known. Each of the tumbler wheels 35, 36 and 37 are of conventional type designed to be changed by means of a conventional resetting key to vary the combination of the lock, and to this end comprise an inner hub on each of which are supported a pair of annular discs having a tumbler gate or peripheral recess, such as the recess 35*a*, therein. The outer annular discs are selectively locked against rotation relative to their supporting hubs by means of conventional locking arms or levers carried by and between the pair of annular discs on each hub and engaging peripheral serrations or teeth on the hub to hold the annular discs at a selected angular position. Conventional flies 38, consisting of annular rings 38*a* having an outwardly extending radial projection 38*b* thereon are provided between the pairs of tumblers 37–36, 36–35, and between tumbler 35 and drive cam 32, and an annular spacer washer 39, for example having an inner diameter conforming to the outer diameter of the tubular post 22 and having a pair of inwardly projecting lugs extending into grooves on the post to prevent its rotation, is provided between each tumbler wheel pair. In the illustrated embodiment, the ring portion 38*a* of each fly may be disposed in a rearwardly facing annular groove, such as groove 35*b*, journaled on the cylindrical surface defining the radially innermost wall of the groove, with the radial projection 38*b* also lying in the groove 35*b* and being of sufficient thickness to project rearwardly into the path of the forwardly projecting drive pin 32*b* on the drive cam. The outermost cylindrical wall of the groove 35*b* is interrupted by a radially outwardly extending cut providing a well of about 20 degrees circumferentially defining stop shoulders flanking the space occupied by the radial lug 38*b* in the path of the radial lug to limit the rotation of the fly to about 20 degrees. This provides the lost motion coupling between the drive cam 32 and the rearmost tumbler 35. The flies associated with the other tumbler wheels 36 and 37 are similarly constructed and disposed in rearwardly facing grooves in those tumblers to provide lost motion couplings coacting with forwardly projecting drive lugs on the tumbler wheels 35 and 36.

The lock is also provided with the usual bolt 40 which is adapted to slide in a suitable guide way formed in one end wall of the lock case 21. The bolt 40 is operated by means of a fence lever 41 which is pivotally attached to the bolt by means of a screw 42. The fence lever 41 is normally resiliently urged to the elevated position illustrated in FIG. 3 by the lever spring 43 having, for example, one leg abutting the fence lever 41 and another leg abutting a stationary surface portion of the lock casing to resiliently urge the fence lever to rotate to the raised position. The fence lever 41 is provided with a laterally projecting bar 44, commonly referred to as a fence, which projects along an axis parallel to the axis of the drive spindle 27 and overlies the peripheries of all of the tumbler wheels 35, 36 and 37. The fence 44 is adapted to be received in the peripheral gate,such as gate 35*a*, of the tumbler wheels when the tumbler gates are disposed in registry with each other at a chosen angular position upon operation of the dial and knob member 26 to the proper opening combination for the lock. When the dial and knob member 26 is rotated in a predetermined manner to bring the zero mark on the dial to a lock opening position, the consequent downward movement of the fence lever 41 causes the fence 44 to enter the peripheral gates of the three tumbler wheels as the fence lever nose descends into the gate of the drive cam, when disposed at the proper angular positions, and the free end of the fence lever 41 is cammed downwardly by the depending boss formation on the upper wall 21*a* of the lock case, and the fence lever 41 may be then shifted laterally to the left of the boss formation, as viewed in FIG. 3, to withdraw the bolt 40 from its projected or locking position.

The drive cam 32 is provided with a drive cam gate 32*c* adapted to receive the nose formation 41*b* of the fence lever 41. As will be observed from the illustration of the drive cam 32 in FIG. 3, the driving cam gate 32*c* has a pair of carefully shaped walls, one forming an inclined slightly convex wall portion for controlling the movement of the fence lever nose 41*b* into the driving cam gate and thereafter controlling the speed of approach of the fence 44 toward the peripheries of the tumbler wheels, and the other wall forming a shoulder for cooperating with a complimentary shoulder on the fence lever nose 41*b* to cause the fence lever to be shifted in a manner to retract the bolt 40 upon rotation of the drive cam in a clockwise direction as viewed in FIG. 3.

It will be appreciated that the stack of tumbler wheels, with their associated flies 38 and the spacer washers 39, may be retained on the tumbler post 22 in the usual manner, by providing a circular outwardly opening groove in a plane perpendicular to the axis of the tumbler post near the rearmost end of the tumbler post, in addition to the two diametrically opposite longitudinal grooves paralleling the tumbler post axis for receiving the spacer washer lugs, and removably locating a split ring or spiral spring ring 45 in the circular groove in the tumbler post bearing against the rearwardly facing edge of the rearmost tumbler or against another washer, if desired, bearing against the rearmost tumbler.

To provide for the adjustment of the tension forces on the tumbler wheel stack governing the torque characteristics or properties of the tumbler wheel stack, the rearwardly facing surface of the front wall 23 of the lock case 21 is provided with a circumferentially arranged series of three arcuate ramp segments 50*a*, 50*b* and 50*c* arranged in an annular path concentric with and outwardly surrounding the tumbler post, providing arcuate ramp surfaces progressively rising rearwardly from a forwardmost, deeper ramp end portion 51 to a rearmost, shallower ramp end portion 51' substantially flush with the remainder of the rear surface of the front casing wall 23. Bearing against the inclined ramp surfaces of the ramp segments 50*a*–50*c* and interposed between these ramp surfaces and the forwardmost surface of the forwardmost tumbler wheel 37 is an angularly adjustable or rotatable torque adjuster member 52 having a circular center ring portion 53 whose inner diameter conforms to the outer diameter of the tumbler post 22 to be journaled for rotation thereon, and having three cricumferentially extending spring finger formations 54 bent along forwardly inclined paths of greater slope than the inclined ramp surfaces of the ramp segments 50*a*–50*c* to track on the ramp segment surfaces. The ramp segment surfaces form, in effect, cam surfaces and the spring finger formations 54 form resilient follower surfaces so that the center ring portion 53 bears against the forwardmost tumbler or against the spacer washer bearing against the forwardmost tumbler, applying a spring tension force to the tumbler stack pressing it against the rearward retaining ring 45 with a tension force related to the position of the spring follower fingers 54 on the ramp segment surfaces to impart the desired torque characteristics to the tumbler stack. The torque adjuster member 52 further contains an outwardly projecting, generally fan-shaped sector 55 having gear teeth 56 on the curved outer perimeter thereof engaging, in the emboidment illustrated in FIG. 4, a small diameter rotatable drive pinion gear 57 journaled for rotation about a stationary axis against the front wall 23 of the lock casing by a pinion support 58. The pinion support 58 has a circular opening therein to accommodate insertion of the end portion of a drive tool, such as an allen wrench or other similar non-round elongated adjusting tool, and the center of the drive pinion 57 is provided with an opening having a non-round cross section conforming to the cross section of the adjusting tool. It will be appreciated that the tension force applied by the torque adjuster member 52 on the stack of tumblers can then be readily adjusted by personnel at the factory or in the field, when the rear cover plate has been removed, by inserting the adjusting tool such as the hexagonal cross section end portion of an allen wrench into the opening therefor in the gear support 58 and into the non-round center opening of the drive gear 57 (or through an adjusting tool accepting hole in the rear cover plate, if desired, to make adjustments without removing the cover, as later described) to rotate the drive gear 57 and thus rotate the torque adjuster member 52 whose teeth 56 engage the teeth of the drive gear 57 to establish the desired torque properties.

Figure 7:
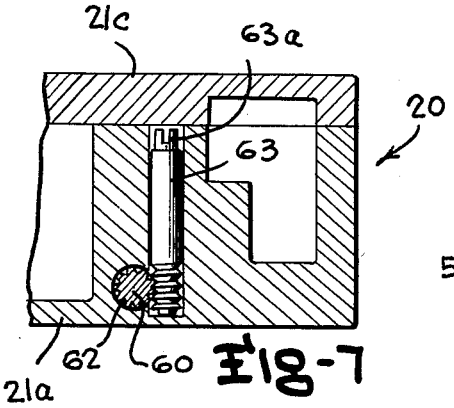
FIG. 7 is a horizontal section view taken along the line 7—7 of FIG. 6.
Figure 5:
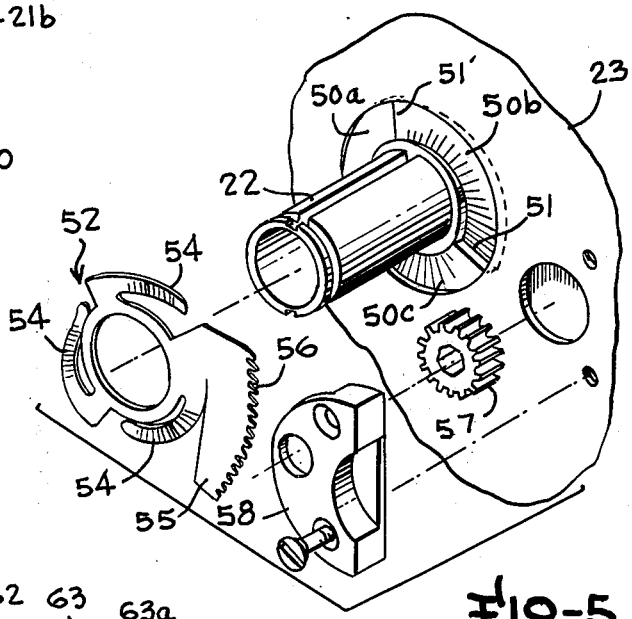
FIG. 5 is a fragmentary exploded perspective view of the portion of the front wall of the lock cover surrounding the tumbler post, showing the arcuate ramp formations on the front wall of the lock casing.
Figure 6:
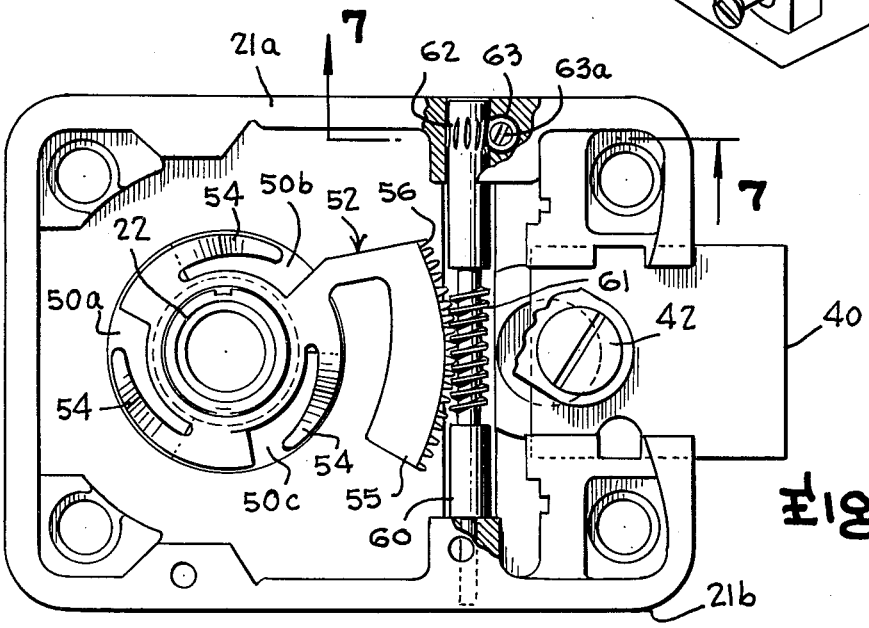
FIG. 6 is a rear elevarion view similar to FIG. 4, but showing a modified form of wheel tension adjusting member and mechanism for adjusting the same.

Another embodiment is illustrated in FIGS. 6 and 7, wherein the lock is provided with the same series of arcuate ramp segments 50*a*, 50*b* and 50*c* as in the previously described embodiment and with the same torque adjuster member 52, but which is provided with a different mechanism for driving the torque adjuster member 52 to different angular positions. In the embodiment illustrated in FIGS. 6 and 7, the drive mechanism for the torque adjuster member 52 comprises a vertically extending worm shaft 60 journaled at its upper and lower ends in the top and bottom walls 21*a*, 21*b* of the lock case 21, and having a worm screw section 61 near its center interfitted with the teeth 56 of the torque adjuster member 52, and having narrow grooves or slots 62*a* cut in the upper end portion of the shaft to form gear teeth interfitting with the teeth of a rotatable drive screw or worm 63 extending forwardly through a portion of the top wall 21*a* of the lock case from the rearmost edge thereof. In the illustrated example, the rearmost end of the drive screw or worm 63 is flush with the rearmost edge of the top wall 21*a* of the lock case and has a crosswise slot 63*a* therein to be engaged by the bit of a screwdriver or similar driving tool, when the rear cover 21*c* of the lock is removed, for rotating the drive worm shaft 60 and thus rotating the torque adjuster member 52 through the desired arcuate range to apply the desired tension force to the stack of tumbler wheels.

It will be appreciated that as the rotatable drive screw or worm 63 is rotated by a screwdriver or similar tool, the worm shaft 60 will be rotated about its axis, such that rotation of its worm screw section 61 interfitted with the gear teeth 66 on the curved perimeter of the fan-shaped sector portion 55 of the torque adjuster member 52 causes the member 52 to rotate about the axis of the tumbler post 22. If the drive screw or worm 63 and the vertically extending worm shaft 60 are rotated in the direction to rotate the torque adjuster member 52 through an arc in the counterclockwise direction, this causes the spring finger formations 54 to ride up on progressively higher portions of the ramp surfaces 50*a*-50*c*, thus resiliently urging the center ring portion 53 with greater tension force against the forwardmost spacer washer bearing against the forwardly facing surface of the forwardmost tumbler wheel 37 to progressively increase the tension on the stack of tumbler wheels and thereby increase the torque thereof.

Figure 8:
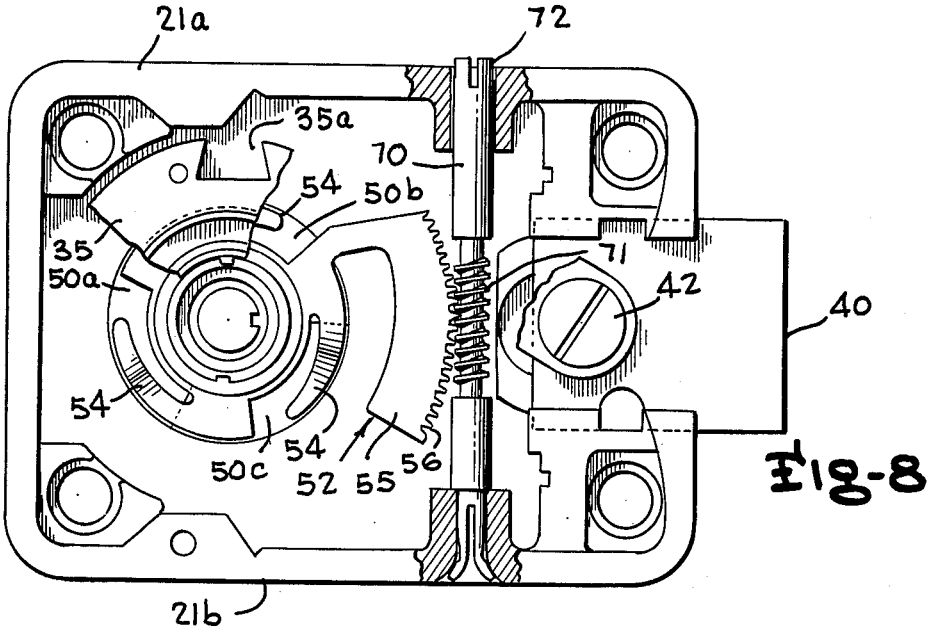
FIG. 8 is a rear elevation view similar to FIG. 4, but showing yet another modified form of wheel tension adjusting member and means for adjusting the same.

Yet another modification is illustrated in FIG. 8, wherein the lock casing is again provided with the same series of arcuate ramp segments 50*a*, 50*b* and 50*c* as in the two previously described embodiments, and with the same torque adjuster member 52, and with a vertically extending worm shaft 70 similar to the worm shaft 60 of the FIG. 6 embodiment, journaled at its upper and lower ends in the top and bottom walls 21*a*, 21*b* of the lock case. In this embodiment, the upper end portion of the vertically extending worm shaft 60 extends entirely through the top wall 21*a* of the lock case and has an upwardly projecting external end portion 72 provided with a screw driver slot or a hexagonal socket designed to fit the end of an allen wrench or the like, so that a screw driver, allen wrench, or similar tool can be applied to the external upper end portion 72 of the worm shaft 70 to rotate the worm shaft. The worm shaft 70, like the worm shaft 60, has a worm screw section 71 near its center interfitted with the gear teeth 56 of the torque adjuster member 52 to rotate the latter about the tumbler post 22. As with the previously described embodiment, rotation of the vertically extending worm screw 70 in the appropriate direction will rotate the torque adjuster member 52 in a clockwise direction, through the action of the interfitted teeth 56 and worm section 71, causing the spring finger formations 54 to ride upwardly on progressively higher portions of the inclined ramp surfaces of the ramp segments 50*a*–50*c* and thus causing the center ring portion 53 of the torque adjuster member 52 to exert progressively greater spring tension rearwardly against the forwardmost spacer washer 39 bearing against the forward surface of the forwardmost tumbler wheel 37, thus altering the torque characteristics of the stack of tumbler wheels.

Figure 9:
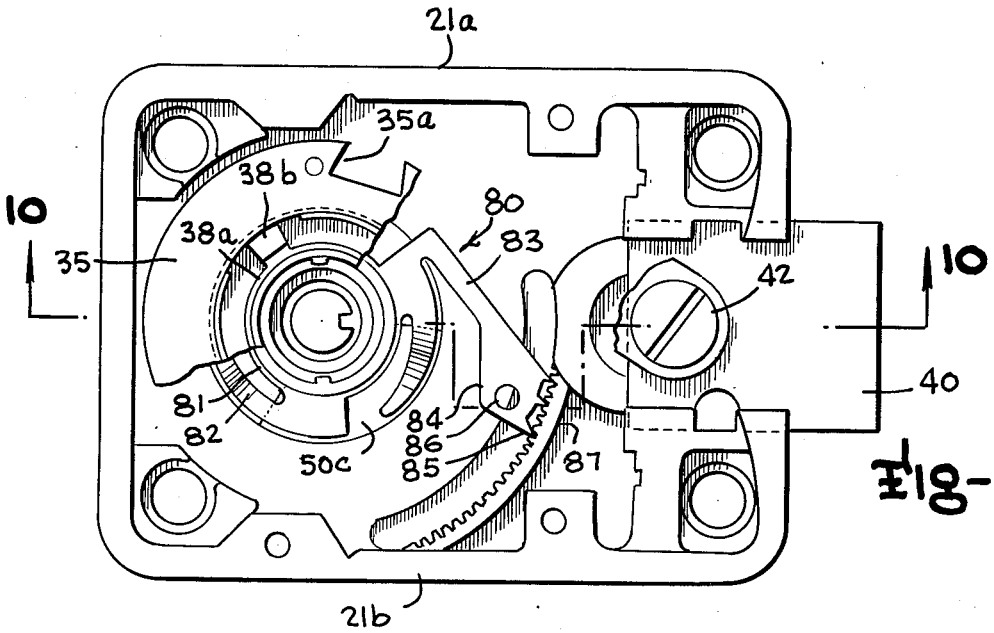
FIG. 9 is a rear elevation view similar to FIG. 4, showing yet another form of wheel tension adjusting mechanism embodying the present invention.
Figure 10:
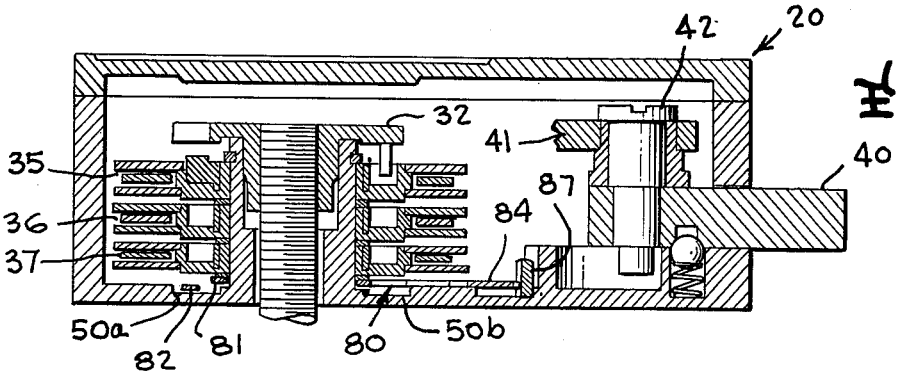
FIG. 10 is a vertical section view of the embodiment of FIG. 9, taken along the line 10—10 of FIG. 9.

FIGS. 9 and 10 illustrate yet another form of mechanism for adjusting the tension on the stack of tumbler wheels and thereby varying the torque characteristics thereof, wherein the lock case, again, is provided with the same series of arcuate ramp segments 50*a*, 50*b* and 50*c* on the front wall 23 of the lock case 21, but wherein the torque adjuster member, here indicated by the reference character 80, is of slightly different construction. In this embodiment, the torque adjuster member 80 is again formed of thin spring metal similar to that used for the torque adjuster member 52 and is provided with the same circular center ring portion 81 whose inner diameter conforms to the outer diameter of the tumbler post 22 to be journaled for rotation thereon, and having the three circumferentially extending spring finger formations 82 extending in a trailing direction and bent along forwardly inclined paths of greater slope than the inclined ramp surfaces of the ramp segments 50a–50c to track on the ramp segment surfaces, thus forming, in effect, resilient follower surfaces riding on the ramp surfaces which act as cam surfaces. However, instead of having the fan-shaped sector 55 with the peripheral gear teeth 56 thereon, the torque adjuster member 80 in this embodiment is provided with an integral, outwardly extending spring tensioned arm 83 extending outwardly along a path inclined to radii of the ring portion 81 and having an enlarged head 84 at its outer end provided with an outwardly directed ratchet tooth 85 and having a hole 86 therein designed to receive the end of a change key or other tool. The tooth 85 is normally resiliently held in the notches formed between the teeth on the arcuate serrated stop wall 87 formed along the inner surface of the front wall 23 of the lock case along a curved arcuate path substantially concentric with the axis of the tumbler post 22. It will be appreciated that in this embodiment, the person desiring to adjust the torque on the stack of tumbler wheels, when the rear cover of the lock case is removed, can do so by inserting the change key or other tool into the hole 86 in the head 84 of the torque adjuster member 80 to push the spring tensioned arm 83 and head 84 toward the center of the tumbler stack to retract the tooth 85 from interfitting relation with the notches formed between the teeth of the stop wall 87, and then move the change key or tool in an arcuate path to impart counterclockwise or clockwise rotation to the torque adjuster member 80 to establish the desired tension force on the stack of tumblers by movement of the spring finger formations 82 along the inclined ramp surfaces, and then releasing the retractive or deforming force on the spring tensioned arm 83 to allow the tooth 85 to engage an appropriate notch of the tooth stop wall 87 to hold the torque adjuster member 80 in the new angular position.

Figure 4:
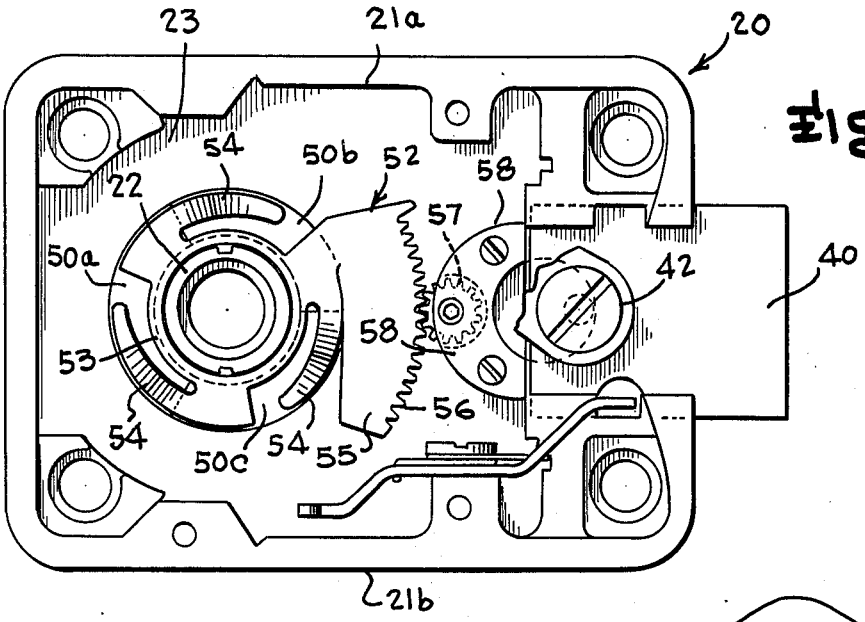
FIG. 4 is a rear elevation view similar to FIG. 3, with the driving cam and stack of tumbler wheels removed, revealing the wheel tension adjusting member for varying the torque properties of the wheel tumbler stack.

It will be appreciated that combination locks having the torque adjuster mechanisms of the constructions illustrated in FIGS. 4 and 6 may be provided with a hole in the rear cover plate 21c rearwardly aligned with the non-round center opening or socket of the drive gear 57 or the drive screw 63 to permit insertion of the tool to rotate the drive gear 57 or drive screw 63 for angular adjustment of the torque adjuster member 52 to the desired position, and in the case of the ratchet type torque adjuster mechanism of FIGS. 9–10, the rear cover plate 21c may be provided with an arcuate slot of appropriate length and width to accommodate insertion of the actuating tool into the hole 86 in the enlarged head 84 of the spring tension arm 83 to permit retraction of the ratchet tooth 85 from the serrated stop wall 87 and movement through an arc appropriate to set the torque to the desired level. Alternatively, the access holes or slots in the rear cover plate may be eliminated and the person desiring to adjust the torque of a lock for these versions may simply remove the rear cover plate to gain access to the torque adjuster member. Of course, with the FIG. 8 version, where the external upper end portion 72 of the worm shaft 70 is exposed above the top wall of the lock case, the worm shaft is accessible to operation by the operating tool without requiring removal of the cover plate or provision of an access opening therein.

The procedure for setting the desired torque for the combination lock when the cover plate is to be removed to gain access to the means for rotating the torque adjuster member to new settings, or where the lock mounting conditions do not allow torque readings from the dial side, the person desiring to set the torque properties of the lock should remove the lock cover annd disassemble the drive cam and dial, and place a torque wrench having a facsimile drive cam on the operating end thereof in place with its facsimile drive cam occupying the position of the regular drive cam. The operator should then rotate the tumbler wheels 35–37 with the torque wrench a minimum of four full revolutions and read the torque indicated by the torque wrench. If the torque reading indicates that readjustment of the torque is necessary because of departure of the torque reading from the desired torque specifications, the adjuster wrench, such as an allen wrench, should then be inserted into place in the non-round center opening of the drive gear 57 if the lock is of the FIG. 4 construction, or in the adjuster wrench socket in the exposed end 72 of the worm shaft 70 if the lock is of the FIG. 8 version, and the adjusting wrench should be turned counterclockwise to lessen the torque below the required amount and then turned clockwise to cause rotation of the torque adjuster member 52 to apply the appropriate compressive spring force to the tumbler wheel stack to produce the desired or specified torque reading on the torque wrench. It should be noted that the final adjustment should be achieved always with clockwise direction turn of the adjuster wrench, and if the torque is overadjusted, the procedure should be repeated to lessen the torque below the required amount and then effect final adjustment in a clockwise turning direction to achieve the specified torque reading. The torque reading from the torque wrench should be made in all cases when all tumbler wheels are being turned in one direction after four full turns minimum. It will be appreciated that in the case of the torque adjuster mechanism of the construction illustrated in FIGS. 9 and 10, the torque adjuster tool or wrench, instead of being turned to effect movement of the torque adjuster member 52, is simply inserted in the hole 86 in the enlarged head 84 of the torque adjuster member and is moved radially inwardly toward the center axis of the tumbler post to retract the ratchet tooth 85 from the serrated or toothed stop wall 87 and shifted along an arcuate path first in the clockwise direction to reduce torque below the specified level, and then in a counterclockwise direction (as viewed in FIG. 9) to bring the torque reading to the desired level.

In the case where it is desired to adjust the torque of the combination lock with a torque wrench applied to the dial hub of the dial and knob member 26 at the front of the lock, where lock mounting conditions allow it, the torque wrench is simply placed over the dial hub and turned clockwise approximately 360° and counterclockwise approximately 360° to indicate the torque on the dial and cam. After measuring the torque of the dial and cam assembly, the dial is turned with the torque indicator in one direction, either clockwise or counterclockwise, for a minimum of four full revolutions and the torque reading taken during revolution of the dial through the four full revolutions. During this operation, the torque reading will gradually show an increase until it reaches a relatively constant reading. The dial with the torque indicator should then be rotated in the opposite direction from the direction in which it was rotated for the immediately preceding readings, and the torque readings noted while the dial is being rotated through at least four full revolutions. If the torque reading is not as desired per specifications, the adjuster wrench should be inserted through the access hole therefor in the rear cover, for those versions of the lock other than the FIG. 8 version, or if access holes or slots are not provided in the rear cover, the rear cover should be moved and the adjuster wrench inserted, to couple the adjuster wrench with the drive gear 57 or adjuster worm 70. The adjuster wrench is then turned in the counterclockwise direction to lessen the torque reading below the desired level, and then the adjuster wrench is turned clockwise slowly increasing the torque to its specified amount. In the case of the FIG. 6 version, the screwdriver bit or similar tool is inserted through the appropriate access hole therefor in the rear cover plate, if one is provided, or is inserted in the slot 63*a* of the drive screw 63 after the cover plate is removed, and is rotated first in the counterclockwise direction to lessen the torque reading below the desired level and then turns in the clockwise direction to slowly increase the torque to its specified amount. In the case of the lock construction illustrated in FIGS. 9 and 10, the adjuster wrench or tool is inserted through the access slot provided therefor in the rear cover plate 21*c*, if one is provided, to enter the hole 86 in the torque adjuster member head 84, or the rear cover plate is removed and the adjuster wrench or tool inserted in the hole 86, after the initial torque readings are taken with the torque indicator, in both directions, as described in connection with the other combination locks formed, and the ratched tooth 85 is released from the serrated stop wall 87 and the torque adjuster member is rotated first in a clockwise direction to decrease torque below the desired level and then is moved in a counterclockwise direction to slowly increase the torque to its specified amount.

It has been discovered that with prior art tumbler wheel combination locks having bowed spring washers or the like to exert tension forces on the tumbler wheel pack, repeated impact forces on the lock or the door carrying the lock, as with a hammer, sledge, or strong piece of lumber such as a two-by-four, may strain the spring means by impelling the pack of tumbler wheels rearwardly against the spring means sufficiently to reduce the tension on the tumbler wheel pack to a point where the vibrations may "walk" the tumbler wheels to positions facilitating unauthorized opening of the lock. The possible straining of the spring means in this manner of attack may be avoided by providing a cylindrical well or cavity in the rearwardly facing surface of the front wall of the lock case to accommodate the spring means, but which is not as large in diameter as the tumbler wheels, so that such impact forces on the lock or door only impells the peripheries of the tumbler wheels against the front wall portions of the lock case bounding the well for the spring means without straining the spring means or the spring fingers of the torque adjuster member of the previously described embodiments.

Figure 2:
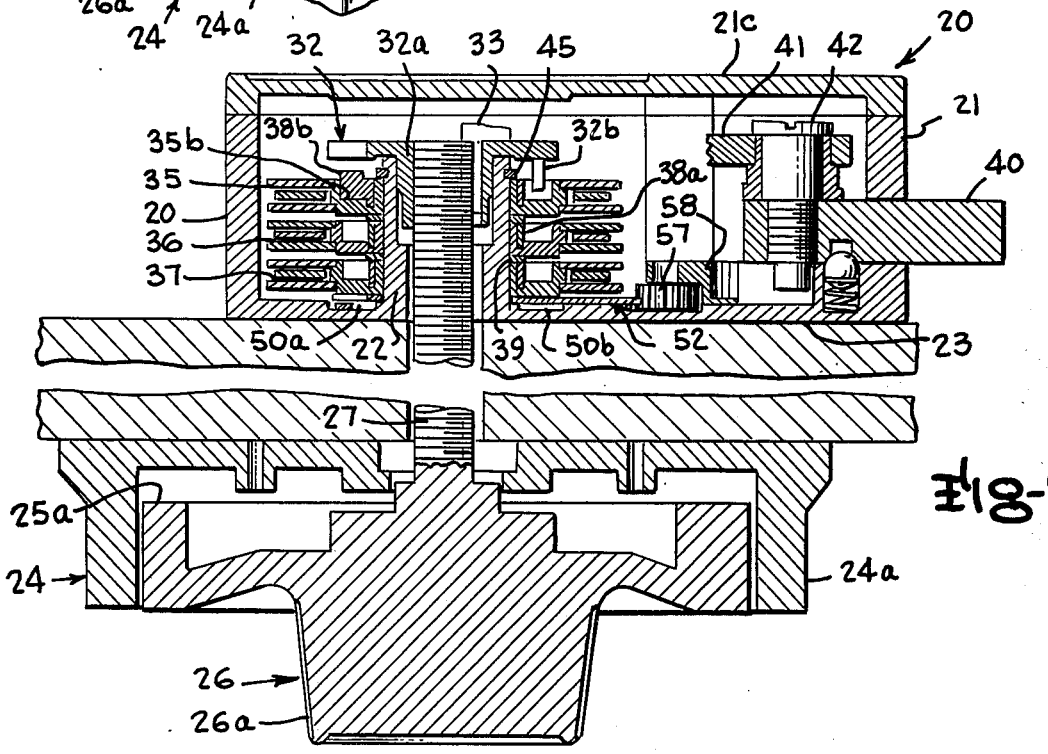
FIG. 2 is a horizontal section view of a combination lock, taken along the line 2—2 of FIG. 1.
Figure 3:
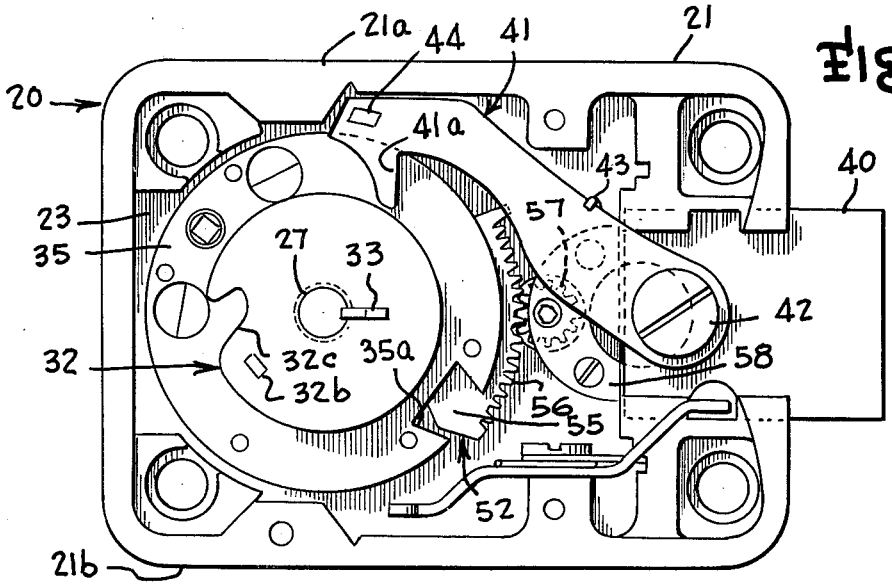
FIG. 3 is a rear elevation of a combination lock with the rear cover removed, showing the lock in locked condition.
Figure 11:
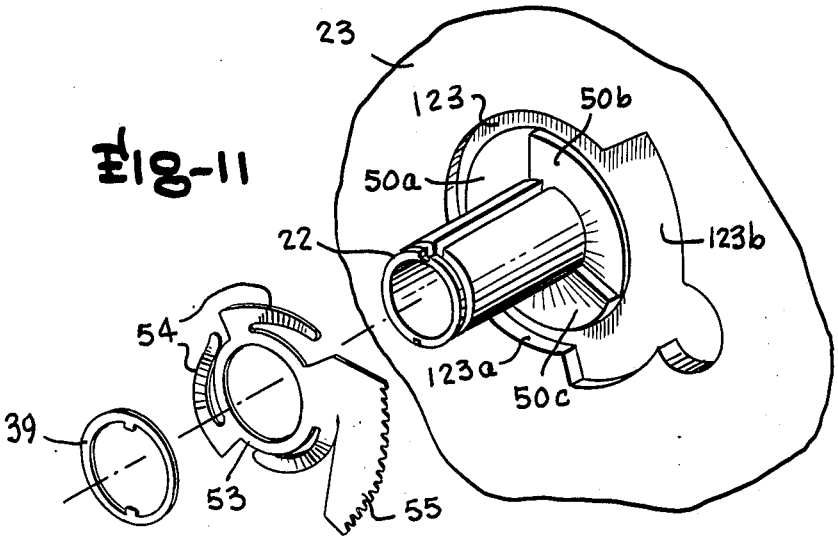
FIGS. 11 and 12 are an exploded fragmentary perspective view and a fragmentary enlarged section view, showing the portions of modifications of the torque adjuster structure of FIGS. 4 and 6, respectively, in the region of the front tumbler wheel and adjacent case portions.

For example, as shown in FIG. 11, the center ring portion 53 and spring finger formations 54 of the torque adjuster member 52 of the embodiment shown in FIGS. 2–4 are nested in a rearwardly facing well of the generally cylindrical configuration indicated at 123 in FIG. 11, having a diameter slightly smaller than the maximum diameters of the tumbler wheels 35, 36 and 37, and having a lateral recess sector extension 123*b* to receive the sector 55 of the adjuster 52. The circular outer bounding wall 123*a* of the well 123 encircles the spring fingers 54 and ring portion 53 but lies radially inwardly of the peripheral edges of the tumbler wheels 35, 36, 37 to forwardly underlap the edges of the tumbler wheels and abut the edges of the forwardmost tumbler wheel 37 should impact forces on the lock impell the tumbler wheel pack forwardly enough to produce such engagement. The ramp surfaces 50*a*, 50*b* and 50*c* are formed in the forwardmost wall of the well 123 and coact with the spring finger formations 54 as in the embodiment of FIGS. 1–4.

Figure 12:
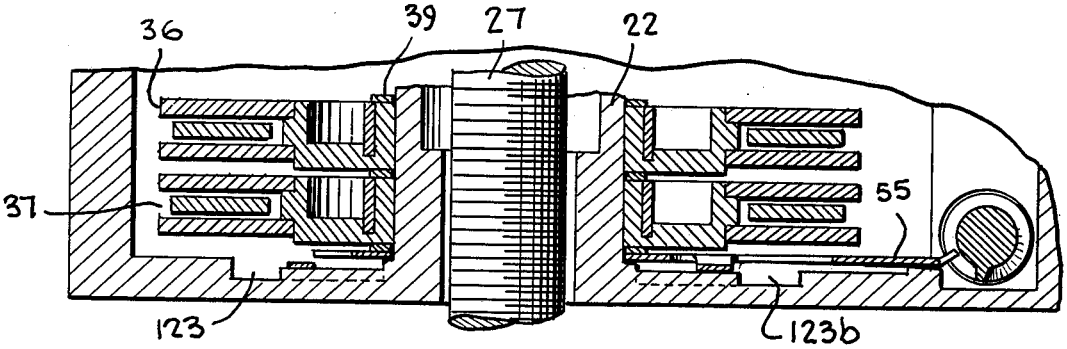

Similarly, FIG. 12 illustrates in fragmentary section portions of a lock similar to that of FIG. 6 (viewed along a section plane similar to line 2—2 of FIG. 1) wherein the front wall of the lock case is provided with a cylindrical well 223 concentric with the axis of the tumbler post, similar to the well 123 of FIG. 11, having the circumferentially spaced series of ramp formations 50*a*, 50*b* and 50*c* like the ramps 50*a*, 50*b* and 50*c* of FIG. 11 and having extension 223*b* for adjuster sector 55, coactive with the finger formations 54 of FIG. 6 in the same manner as the FIG. 11 embodiment. As in the FIG. 11 form, the diameter of the cylindrical portion of well 223 is slightly less than that of the tumbler wheels so that impact forces in the tumbler wheel pack impells the peripheral portion of the forwardmost tumbler wheel 37 into contact with the front wall portions of the case outwardly bounding the well thus protecting the spring fingers against stresses which might reduce the spring tension or torque level on the tumbler wheels. It will be appreciated that such a cylindrical well as the well 123 or 223 of FIGS. 11 and 12 may be provided in the embodiments of FIGS. 7–8 or 9–10 coactive with the spring finger formations in the same manner as the FIG. 2–6 embodiments to protect the spring finger portions of the torque adjuster member against impact stresses in the same manner so that the torque level adjustment for the tumbler wheel pack will be substantially preserved.

While the several embodiments of the torque adjuster invention herein described all involve an adjuster member 52 which is constructed so as to be rotatable about the center axis of the tumber post 22, it will be appreciated that a torque adjuster member which is rectilinearly reciprocatively movable along a straight line axis back-and-fourth relative to an inclined ramp surface on the rearwardly facing surface of the front case wall 23, for example along a rectilinear path paralleling or perpendicular to, or inclined to, the bolt movement axis, may be employed instead of the rotatable torque adjuster member 23. In that case, the torque adjuster member may have a slot sized to accomodate the tumbler wheel post 22 and permit movement of the adjuster member through a range such that spring finger formations on the adjuster member ride along ramp surfaces on the case front wall adjacent the tumbler post 22 to vary the tension force on the tumbler wheels and their associated flies 38 and washers 39.

The rectilinearly reciprocative slide torque adjuster member is adjusted to the desired tumbler wheel tension position by a tool operated pinion drive gear, similar to gear 57 of FIG. 4, or a worm drive gear similar to gear 61 of FIG. 6, or by any other known drive mechanism, operated by a tool coupled to the drive member either through an access tool opening in the case or cover plate or by access when the cover plate is removed.

While several preferred and practical embodiments of the invention have been disclosed in the above description, it will be understood by those skilled in the art that the disclosure represents exemplary embodiments and that other arrangements of parts cooperable to carry out the inventive concept are to be regarded as within the purview of the invention.

What is claimed is:

1. In a combination lock having a lock case provided with front and rear walls and a cylindrical tumbler post normally extending along a horizontal axis from one of said walls, a tumbler wheel stack formed of a plurality of peripherally gated tumbler wheels loosely journaled on said tumbler post for rotation about the axis of the tumbler post, retainer shoulder means on an end portion of the tumbler post for retaining the tumbler wheel stack thereon, a peripherally gated rotatable driving cam driven by a rotatable dial, means for driving the tumbler wheels responsive to rotation of the dial and driving cam, and a fence lever pivotally connected to a bolt for shifting the bolt between locked and unlocked positions; the improvement comprising means for adjusting the torque properties of the tumbler wheel stack including stationary inclined ramp means adjacent said tumbler post and facing toward the tumbler stack providing inclined ramp cam surfaces, a torque adjuster spring member journaled for rotation on the tumbler post between said inclined ramp means and the nearest tumbler wheel having cam follower formations bearing against said inclined ramp cam surfaces to track along the latter and having an abutment portion for asserting resilient forces directed axially against the nearest tumbler wheel urging the stack of tumbler wheels compressively against said retainer shoulder means for varying the compressive spring forces on and torque properties of the stack of tumbler wheels in accordance with the positions of the cam follower formations on the inclined ramp surfaces, and the torque adjuster spring member including an extension portion projecting laterally of the tumbler post having a coupler formation thereon, the lock case having interfitting means carried thereby interfitting with said coupler formation to releasably hold the torque adjuster member at various angular positions to which it is adjusted, and the coupler formation and interfitting means being relatively movable for rotation of the torque adjuster member through arcuate paths in either of opposite directions about the axis of said tumbler post and for restraining the same at the angular position to which it is adjusted for variably setting resilient compressive forces on the tumbler stack and thereby adjusting the torque characteristics.

2. A combination lock as defined in claim 1, wherein said torque adjuster member is a thin sheet metal member formed of flat spring metal having an annular center ring portion encircling the tumbler post and forming the abutment portion for exerting resilient rearward spring forces against the nearest tumbler wheel of the stack.

3. A combination lock as defined in claim 2, wherein said extension portion of the torque adjuster means is a sector formation having gear teeth along its arcuate outer periphery and said interfitting means comprising a rotatable gear member supported for rotation in the lock case having teeth interfitting with the sector gear teeth of the torque adjuster member for shifting the latter to various positions along its arcuate path and having a coupling formation for receiving an adjusting tool for rotation of the interfitting means to adjust the tension adjuster member.

4. A combination lock as defined in claim 3, wherein said gear member is a pinion gear supported for rotation about an axis paralleling the tumbler post axis, the pinion gear having a rearwardly opening non-round socket in the center thereof to receive the end portion of an adjusting tool for rotating the pinion gear and thereby adjusting the angular position of the torque adjuster member about said tumbler post.

5. A combination lock as defined in claim 3, wherein said gear member is a rotatable worm shaft having a worm screw section interfitted with the sector gear teeth on said torque adjuster member, the worm shaft being supported in the lock case for rotation about an axis perpendicular to the axis of the tumbler post and having means adjacent an end thereof to receive and be rotated by an adjusting tool.

6. A combination lock as defined in claim 5, wherein said worm shaft includes a worm gear on an end thereof, and the lock including a second rotatable worm screw extending along and rotatable about an axis paralleling the tumbler post axis and interfitting with the worm gear on said worm shaft for driving the latter.

7. A combination lock as defined in claim 1, wherein said extension portion of the torque adjuster member is a flexibly deformable spring arm extending beyond the peripheries of the tumbler wheels and terminating in a ratchet tooth at the outermost end portion thereof, and said interfitting means comprises a concave arcuate serrated stop wall having notches between the teeth thereof for receiving the ratchet tooth therein, the resiliently deformable spring arm being capable of being manually flexed to withdraw the ratchet tooth from restraining interfitting engagement with notches of the stop wall for manual angular readjustment of the torque adjuster member to a different angular position for resetting the torque characteristics of the tumbler stack and the spring arm being resiliently urged upon manual release thereof to return the ratchet tooth into notch portions of the stop wall to restrain the torque adjuster member in the reset angular position.

8. A combination lock as defined in claim 1, wherein said torque adjuster member is a thin spring metal member having an annular center ring portion forming said abutment portion encircling the tumbler post and having a generally fan-shaped extension sector forming said extension provided with sector gear teeth lying in an arcuate path along its perimeter, and said interfitting means comprising a drive gear interfitted with said sector gear teeth and including coupling recess means to receive an adjusting tool for imparting rotation to the interfitting means and thereby rotate the torque adjuster member through selected arcs to position the cam follower formations thereof at various positions along the inclined ramp surfaces.

9. A combination lock as defined in claim 8, wherein the drive gear of said interfitting means is a pinion gear supported for rotation about said axis paralleling the tumbler post axis, the pinion gear having a rearwardly opening non-round socket in the center thereof to receive the end portion of an adjusting tool for rotating the pinion gear and thereby adjusting the angular position of the torque adjuster member about said tumbler post.

10. A combination lock as defined in claim 8, wherein the drive gear of said interfitting means is a rotatable worm shaft having a worm screw section interfitted with the sector gear teeth on said torque adjuster member, the worm shaft being supported in the lock case for rotation about an axis perpendicular to the axis of the tumbler post and having means adjacent an end thereof to receive and be rotated by an adjusting tool.

11. A combination lock as defined in claim 10, wherein said worm shaft includes a worm gear on an end thereof, and the lock including a second rotatable worm screw extending along and rotatable about an axis paralleling the tumbler post axis and interfitted with the worm gear on said worm shaft for driving the latter.

12. A combination lock as defined in claim 8, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramps for imparting selected torque properties to the tumbler stack.

13. A combination lock as defined in claim 1, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramps for imparting selected torque properties to the tumbler stack.

14. A combination lock as defined in claim 3, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramp for imparting selected torque properties to the tumbler stack.

15. A combination lock as defined in claim 4, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramps for imparting selected torque properties to the tumbler stack.

16. A combination lock as defined in claim 5, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramps for imparting selected torque properties to the tumbler stack.

17. A combination lock as defined in claim 6, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting said abutment portion to the stack of tumbler wheels rearwardly directed compressive spring forces in accordance with the positions of said contact portions on the inclined ramps for imparting selected torque properties to the tumbler stack.

18. A combination lock as defined in claim 7, wherein said inclined ramp means is in the form of a circumferentially spaced series of similar inclined ramp sectors extending in arcuate paths of similar radius collectively spanning an annular path outwardly encircling the tumbler post and formed on the rearwardly facing surface of the front wall of the lock case, and said torque adjuster spring member includes a plurality of circumferentially elongated finger portions equal in number to the number of inclined ramp sectors extending along arcuate paths inclined in forwardly convergent relation to the inclined ramp surfaces and having terminal contact portions bearing against the inclined ramp surfaces, said elongated finger portions transmitting through said abutment portion to the stack of tumbler wheels rearwardly directed compressive spring forces in accordance with the positions of said contact portions on the inclined ramps for imparting selected torque properties to the tumbler stack.

19. A combination lock as defined in claim 1, including means forming an annular cylindrical well of smaller outer diameter than the tumbler wheels recessed in the case wall portion immediately adjoining the tumbler post, said stationary inclined ramp means being located within said well recessed below surrounding wall surface portions of the case forming protective abutment surfaces outwardly encircling the well, and the cam follower formations engaging the ramp surfaces within the well and being spaced inwardly toward the tumbler post from said protective abutment surfaces whereby engagement of the abutment surfaces with peripheral portions of the adjacent tumbler wheel when impact forces are applied to the lock impelling the tumbler wheel stack against said case wall portion protects the cam follower formation from flattening against said ramp surfaces.

20. A combination lock as defined in claim 7, including means forming an annular cylindrical well of smaller outer diameter than the tumbler wheels recessed in the case wall portion immediately adjoining the tumbler post, said stationary inclined ramp means being located within said well recessed below surrounding wall surface portions of the case forming protective abutment surfaces outwardly encircling the well, and the cam follower formations engaging the ramp surfaces within the well and being spaced inwardly toward the tumbler post from said protective abutment surfaces whereby engagement of the abutment surfaces with peripheral portions of the adjacent tumbler wheel when impact forces are applied to the lock impelling the tumbler wheel stack against said case wall portion protects the cam follower formation from flattening against said ramp surfaces.

21. A combination lock as defined in claim 8, including means forming an annular cylindrical well of smaller outer diameter than the tumbler wheels recessed in the case wall portion immediately adjoining the tumbler post, said stationary inclined ramp means being located within said well recessed below surrounding wall surface portions of the case forming protective abutment surfaces outwardly encircling the well, and the cam follower formations engaging the ramp surfaces within the well and being spaced inwardly toward the tumbler post from said protective abutment surfaces whereby engagement of the abutment surfaces with peripheral portions of the adjacent tumbler wheel when impact forces are applied to the lock impelling the tumbler wheel stack against said case wall portion protects the cam follower formation from flattening against said ramp surfaces.

22. A combination lock as defined in claim 9, including means forming an annular cylindrical well of smaller outer diameter than the tumbler wheels recessed in the case wall portion immediately adjoining the tumbler post, said stationary inclined ramp means being located within said well recessed below surrounding wall surface portions of the case forming protective abutment surfaces outwardly encircling the well, and the cam follower formations engaging the ramp surfaces within the well and being spaced inwardly toward the tumbler post from said protective abutment surfaces whereby engagement of the abutment surfaces with peripheral portions of the adjacent tumbler wheel when impact forces are applied to the lock impelling the tumbler wheel stack against said case wall portion protects the cam follower formation from flattening against said ramp surfaces.

23. A combination lock as defined in claim 12, including means forming an annular cylindrical well of smaller outer diameter than the tumbler wheels recessed in the case wall portion immediately adjoining the tumbler post, said stationary inclined ramp means being located within said well recessed below surrounding wall surface portions of the case forming protective abutment surfaces outwardly encircling the well, and the cam follower formations engaging the ramp surfaces within the well and being spaced inwardly toward the tumbler post from said protective abutment surfaces whereby engagement of the abutment surfaces with peripheral portions of the adjacent tumbler wheel when impact forces are applied to the lock impelling the tumbler wheel stack against said case wall portion protects the cam follower formation from flattening against said ramp surfaces.

24. In a combination lock having a lock case provided with front and rear walls and a cylindrical tumbler post normally extending along a horizontal axis from one of said walls, a tumbler wheel stack formed of a plurality of peripherally gated tumbler wheels loosely journaled on said tumbler post for rotation about the axis of the tumbler post, retainer shoulder means on an end portion of the tumbler post for retaining the tumbler wheel stack thereon, a peripherally gated rotatable driving cam driven by a rotatable dial, means for driving the tumbler wheels responsive to rotation of the dial and driving cam for adjusting the angular positions of the tumbler wheels, and a fence lever pivotally connected to a bolt for shifting the bolt between locked and unlocked positions; the improvement comprising means for adjusting the torque properties of the tumbler wheel stack including stationary inclined ramp means adjacent said tumbler post and facing toward the tumbler stack providing inclined ramp cam surfaces, a torque adjuster spring member journaled for movement along the cam surfaces of said ramp means located between said inclined ramp means and the nearest tumbler wheel, said torque adjuster spring member having cam follower formations bearing against said inclined ramp cam surfaces to track along the latter and having an abutment portion for asserting resilient forces against the nearest tumbler wheel urging the stack of tumbler wheels compressively against said retainer shoulder means for varying the compressive spring forces on and torque properties of the stack of tumbler wheels in accordance with the positions of the cam follower formations on the inclined ramp surfaces, and the torque adjuster spring member including an extension portion projecting laterally of the tumbler post having a coupler formation thereon, the lock case having interfitting means carried thereby interfitting with said coupler formation to releasably hold the torque adjuster member at the positions of adjustment to which it is moved along the cam surfaces of the ramp means, and the coupler formation and interfitting means being relatively movable for adjustment of the torque adjuster member in either of opposite directions relative to the cam surfaces of the ramp means and for restraining the same at the position to which it is adjusted for variably setting resilient compressive forces on the tumbler stack and thereby adjusting the torque characteristics thereof.

* * * * *